US006367087B1

(12) United States Patent
Spillman et al.

(10) Patent No.: US 6,367,087 B1
(45) Date of Patent: Apr. 9, 2002

(54) FOOT COMFORTING DEVICE

(76) Inventors: Margaret Spillman; Anne Spillman, both of 2629 Harding Rd., Yadkinville, NC (US) 27055

( * ) Notice: Subject to any disclaimer, the term of this patent is extended or adjusted under 35 U.S.C. 154(b) by 0 days.

(21) Appl. No.: 09/770,625

(22) Filed: Jan. 26, 2001

(51) Int. Cl.[7] ..... A41B 11/00
(52) U.S. Cl. ..... 2/239
(58) Field of Search ..... 2/239, 240, 241, 2/242, 61; D2/980

(56) References Cited

U.S. PATENT DOCUMENTS 3,601,818 A 8/1971 Chesebro
4,296,499 A * 10/1981 Patterson et al. ..... 2/239
D322,353 S * 12/1991 Bennett ..... D2/277
D347,518 S 6/1994 Stewart
5,450,630 A 9/1995 Hale
5,671,482 A 9/1997 Alvera
5,784,721 A 7/1998 Huff
5,867,837 A 2/1999 Otto et al.
6,012,177 A * 1/2000 Cortinovis ..... 2/239
6,044,497 A * 4/2000 Richardson ..... 2/239

* cited by examiner

*Primary Examiner*—John J. Calvert
*Assistant Examiner*—Alissa L. Hoey

(57) ABSTRACT

A foot comforting device for preventing pain to a user's foot having corns, calluses, and bunions thereon. The foot comforting device includes a cover member having a heel portion and a front portion being adapted to cover a ball of a user's foot, and further being cushioned and being adapted to fit about the user's foot; and also includes at least one elastic strip being attached to the cover member for holding the cover member about the user's foot.

13 Claims, 2 Drawing Sheets

FOOT COMFORTING DEVICE

BACKGROUND OF THE INVENTION

1. Field of the Invention

The present invention relates to a foot comforter and more particularly pertains to a new foot comforting device for preventing pain to a user's foot having corns, calluses, and bunions thereon.

2. Description of the Prior Art

The use of a foot comforter is known in the prior art. More specifically, a foot comforter heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,450,630; U.S. Pat. No. 5,784,721; U.S. Pat. No. 3,601,818; U.S. Pat. No. 5,671,482; U.S. Pat. No. 5,867,837; and U.S. Pat. No. Des. 347,518.

While these devices fulfill their respective, particular objectives and requirements, the aforementioned patents do not disclose a new foot comforting device. The inventive device includes a cover member having a heel portion and a front portion being adapted to cover a ball of a user's foot, and further being cushioned and being adapted to fit about the user's foot; and also includes at least one elastic strip being attached to the cover member for holding the cover member about the user's foot.

In these respects, the foot comforting device according to the present invention substantially departs from the conventional concepts and designs of the prior art, and in so doing provides an apparatus primarily developed for the purpose of preventing pain to a user's foot having corns, calluses, and bunions thereon.

SUMMARY OF THE INVENTION

In view of the foregoing disadvantages inherent in the known types of foot comforter now present in the prior art, the present invention provides a new foot comforting device construction wherein the same can be utilized for preventing pain to a user's foot having corns, calluses, and bunions thereon.

The general purpose of the present invention, which will be described subsequently in greater detail, is to provide a new foot comforting device which has many of the advantages of the foot comforter mentioned heretofore and many novel features that result in a new foot comforting device which is not anticipated, rendered obvious, suggested, or even implied by any of the prior art foot comforter, either alone or in any combination thereof.

To attain this, the present invention generally comprises a cover member having a heel portion and a front portion being adapted to cover a ball of a user's foot, and further being cushioned and being adapted to fit about the user's foot; and also includes at least one elastic strip being attached to the cover member for holding the cover member about the user's foot.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot comforting device which has many of the advantages of the foot comforter mentioned heretofore and many novel features that result in a new foot comforting device which is not anticipated, rendered obvious, suggested, or even implied by any of the prior art foot comforter, either alone or in any combination thereof.

It is another object of the present invention to provide a new foot comforting device which may be easily and efficiently manufactured and marketed.

It is a further object of the present invention to provide a new foot comforting device which is of a durable and reliable construction.

An even further object of the present invention is to provide a new foot comforting device which is susceptible of a low cost of manufacture with regard to both materials and labor, and which accordingly is then susceptible of low prices of sale to the consuming public, thereby making such foot comforting device economically available to the buying public.

Still yet another object of the present invention is to provide a new foot comforting device which provides in the apparatuses and methods of the prior art some of the advantages thereof, while simultaneously overcoming some of the disadvantages normally associated therewith.

Still another object of the present invention is to provide a new foot comforting device for preventing pain to a user's foot having corns, calluses, and bunions thereon.

Yet another object of the present invention is to provide a new foot comforting device which includes a cover member having a heel portion and a front portion being adapted to cover a ball of a user's foot, and further being cushioned and being adapted to fit about the user's foot; and also includes at least one elastic strip being attached to the cover member for holding the cover member about the user's foot.

Still yet another object of the present invention is to provide a new foot comforting device that is easy and convenient to be worn upon the user's foot even while wearing shoes.

Even still another object of the present invention is to provide a new foot comforting device that can be easily cleaned and laundered.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
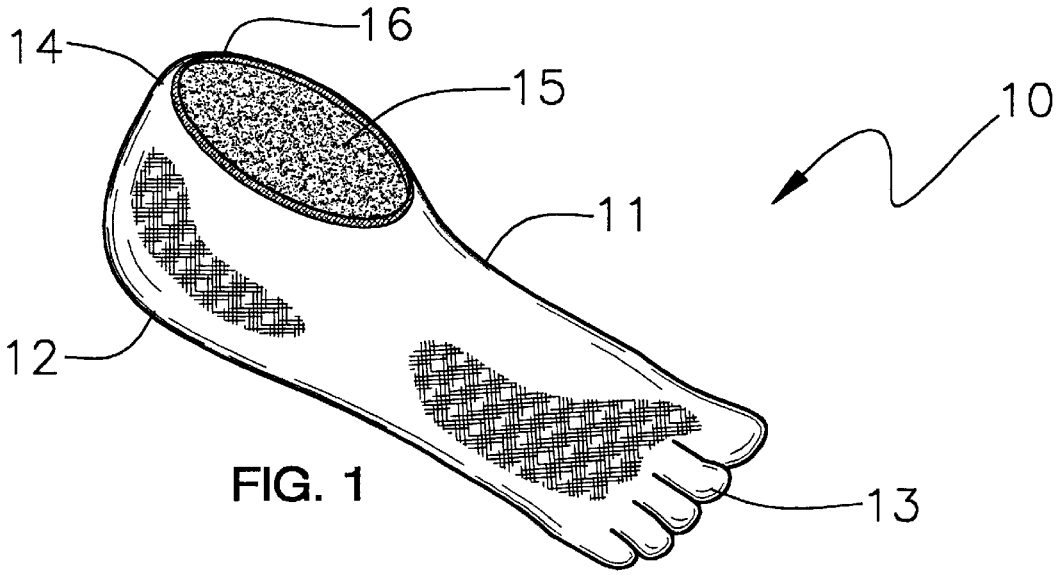
FIG. 1 is a perspective view of a first embodiment of new foot comforting device according to the present invention.
Figure 2:
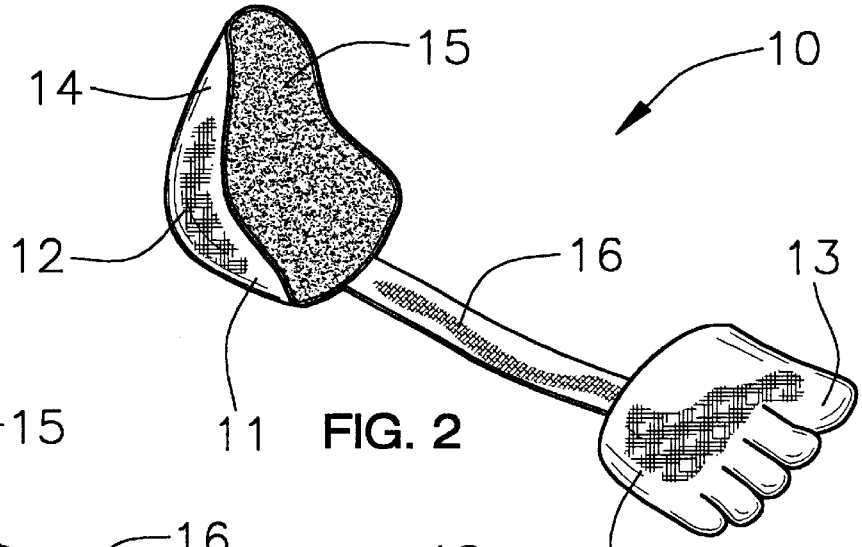
FIG. 2 is a perspective view of a second embodiment of the present invention.
Figure 3:
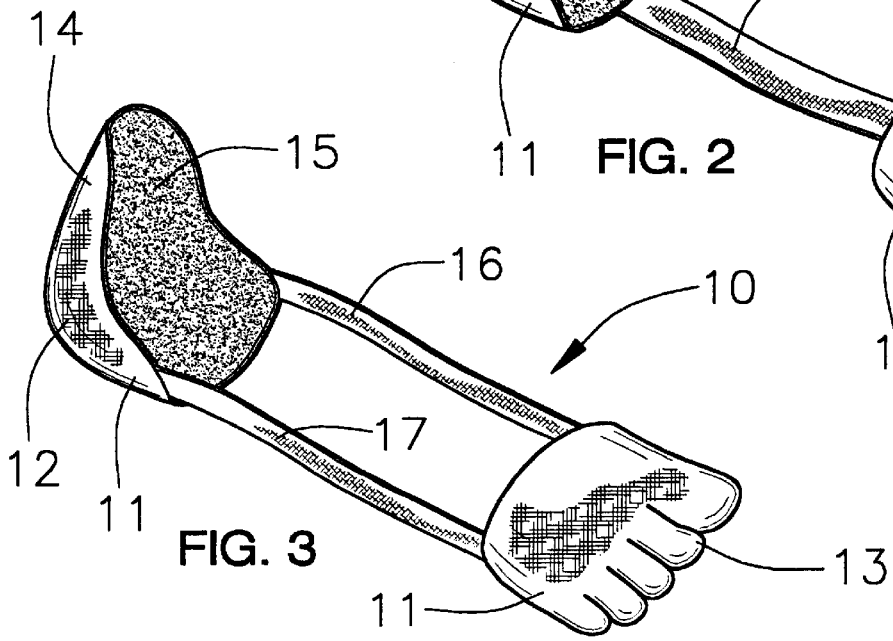
FIG. 3 is a perspective view of a third embodiment of the present invention.
Figure 4:
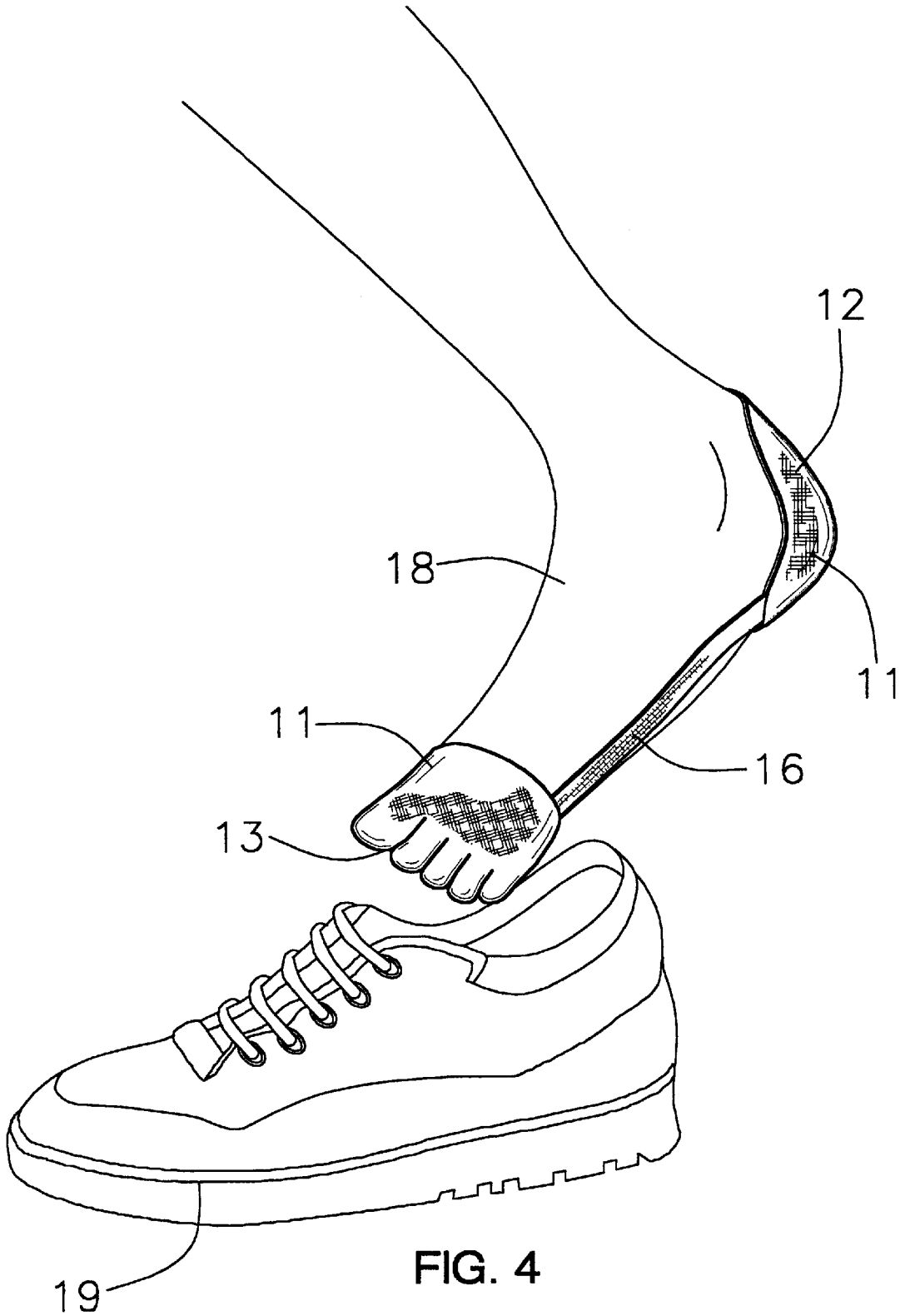
FIG. 4 is a perspective view of the third embodiment of the present invention shown in use.

With reference now to the drawings, and in particular to FIGS. 1 through 4 thereof, a new foot comforting device embodying the principles and concepts of the present invention and generally designated by the reference numeral 10 will be described.

As best illustrated in FIGS. 1 through 4, the foot comforting device 10 generally comprises a cover member 11 having a heel portion 12 and a front portion 13 being adapted to cover a ball of a user's foot 18, and further being cushioned and being adapted to fit about the user's foot 18. The cover member 11 also includes an outer layer of material 14 and an inner layer of absorbent material 15. The outer layer of material 14 is generally made of polyester, and the inner layer of material 15 is generally made of a material selected from a list including fleece and velour.

At least one elastic strip 16,17 is securely and conventionally attached to the cover member 11 for holding the cover member 11 about the user's foot 18. As a first embodiment, the at least one elastic strip 16,17 includes one elastic strip 16 being securely and conventionally attached along an edge of the cover member 11 for holding the cover member 11 upon the user's foot 18. As a second embodiment, the at least one elastic strip 16,17 has ends which are securely and conventionally attached to the heel portion 12 and to the front portion 13 of the cover member 11, and extends therebetween. As a third embodiment, the at least one elastic strip 16,17 includes two elastic strips 16,17 being securely being securely and conventionally attached to sides of the heel portion 12 and the front portion 13 and extending therebetween.

In use, the user fits the cover member 11 appropriately about one's foot 18 to prevent the pain associated with one having corns, calluses, and bunions on one's feet, and the user slides one's foot 18 into a shoe 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A foot comforting device comprising:

a cover member being adapted to fit about portions of a user's foot, said cover member comprising:

a heel portion for positioning adjacent to a heel section of a user's foot, the heel portion having a bottom for positioning adjacent to a sole of the user's foot; and a front portion being adapted to cover a front section of a user's foot including toes and a ball of a user's foot, said front portion having a bottom for positioning adjacent to the ball on the sole of the user's foot;

wherein said portions are formed of a cushioned material; and an elastic strip being attached to and extending between the heel portion and the front portion of said cover member for holding the portions of said cover member on the user's foot, a first end of said elastic strip being connected to the heel portion of said cover member and a second end of said strip being connected to the connected to the front portion of said cover member, said ends of said strip being connected to said bottoms of said heel and front portions of said cover member for positioning said elastic strip adjacent to the sole of the user.

2. A foot comforting device as described in claim 1, wherein the portions of said cover member also include an outer layer of material and an inner layer of absorbent material.

3. A foot comforting device as described in claim 2, wherein said outer layer of material is generally made of polyester.

4. A foot comforting device as described in claim 3, wherein said inner layer of material is generally made of fleece.

5. A foot comforting device as described in claim 3, wherein said inner layer of material is generally made of velour.

6. A foot comforting device comprising:

a cover member being adapted to fit about portions of a user's foot, said cover member comprising:

a heel portion for positioning adjacent to a heel section of a user's foot, said heel portion having a bottom for positioning adjacent to a sole of the user's foot, said heel portion having laterally-spaced sides; and a front portion being adapted to cover a front section of a user's foot including toes and a ball of a user's foot, said front portion having a bottom for positioning adjacent to the ball on the sole of the user's foot, said front portion having laterally-spaced sides;

wherein said portions are formed of a cushioned material; and a pair of laterally-spaced elastic strips being attached to and extending between the heel portion and the front portion of said cover member for holding the portions of said cover member on the user's foot, first ends of each of said strips being connected to the heel portion of said cover member and second ends of said strips being connected to the connected to the front portion of said cover member, said ends of a first one of said strips being connected to a first set of said laterally-spaced sides of said heel and front portions of said cover member and said ends of a second one of said strips being connected to a first set of said laterally-spaced sides of said heel and front portions of said cover member for positioning each of said elastic strips adjacent to sides of the foot of the user.

7. A foot comforting device as described in claim 6, wherein the portions of said cover member also include an outer layer of material and an inner layer of absorbent material.

8. A foot comforting device as described in claim 7, wherein said outer layer of material is generally made of polyester.

9. A foot comforting device as described in claim 8, wherein said inner layer of material is generally made of fleece.

10. A foot comforting device as described in claim 8, wherein said inner layer of material is generally made of velour.

11. A foot comforting device as described in claim 6, wherein each of said elastic strips has a substantially uniform width and a substantially uniform thickness.

12. A foot comforting device as described in claim 1, wherein said elastic strip has a substantially uniform width and a substantially uniform thickness.

13. A foot comforting device comprising:

a cover member being adapted to fit about portions of a user's foot, said cover member comprising:

a heel portion for positioning adjacent to a heel section of a user's foot, said heel portion having a bottom for positioning adjacent to a sole of the user's foot, said heel portion having laterally-spaced sides; and a front portion being adapted to cover a front section of a user's foot including toes and a ball of a user's foot, said front portion having a bottom for positioning adjacent to the ball on the sole of the user's foot, said front portion having laterally-spaced sides;

wherein said portions are formed of a cushioned material; and a pair of laterally-spaced elastic strips being attached to and extending between the heel portion and the front portion of said cover member for holding the portions of said cover member on the user's foot, first ends of each of said strips being connected to the heel portion of said cover member and second ends of said strips being connected to the connected to the front portion of said cover member, said ends of a first one of said strips being connected to a first set of said laterally-spaced sides of said heel and front portions of said cover member and said ends of a second one of said strips being connected to a first set of said laterally-spaced sides of said heel and front portions of said cover member for positioning each of said elastic strips adjacent to sides of the foot of the user;

wherein the portions of said cover member also include an outer layer of material and an inner layer of absorbent material;

wherein said outer layer of material is generally made of polyester;

wherein said inner layer of material is generally made of fleece;

wherein said inner layer of material is generally made of velour; and wherein each of said elastic strips has a substantially uniform width and a substantially uniform thickness.

* * * * *